US006525696B2

(12) United States Patent
Powell et al.

(10) Patent No.: US 6,525,696 B2
(45) Date of Patent: Feb. 25, 2003

(54) DUAL BAND ANTENNA USING A SINGLE COLUMN OF ELLIPTICAL VIVALDI NOTCHES

(75) Inventors: Charles Powell, Plainsboro, NJ (US); Ronald Marino, Flushing, MI (US)

(73) Assignee: Radio Frequency Systems, Inc., Meriden, CT (US)

( * ) Notice: Subject to any disclaimer, the term of this patent is extended or adjusted under 35 U.S.C. 154(b) by 0 days.

(21) Appl. No.: 09/741,380

(22) Filed: Dec. 20, 2000

(65) Prior Publication Data

US 2002/0075195 A1 Jun. 20, 2002

(51) Int. Cl.[7] ..... H07Q 21/00
(52) U.S. Cl. ..... 343/770; 343/725; 343/767
(58) Field of Search ..... 343/770, 820, 343/834, 835, 836, 837, 700 MS

(56) References Cited

U.S. PATENT DOCUMENTS

| | | | | |
|---|---|---|---|---|
| 4,356,492 | A | 10/1982 | Kaloi | |
| 5,023,623 | A | 6/1991 | Kreinheder et al. | |
| 5,162,803 | A | 11/1992 | Chen | |
| 5,502,447 | A | 3/1996 | Kumpfbeck et al. | |
| 5,757,329 | A | 5/1998 | Hoover et al. | |
| 5,812,933 | A | 9/1998 | Niki | |
| 5,818,385 | A | 10/1998 | Bartholomew | |
| 5,872,544 | A | 2/1999 | Schay | |
| 5,905,473 | A | 5/1999 | Taenzer | |
| 5,963,871 | A | 10/1999 | Zhinong et al. | |
| 5,966,102 | A | 10/1999 | Runyon | 343/820 |
| 5,999,140 | A | 12/1999 | Johnson | |
| 6,043,785 | A | 3/2000 | Marino | |
| 6,067,053 | A | 5/2000 | Runyon et al. | |
| 6,069,589 | A | 5/2000 | Lewis, Jr. et al. | |
| 6,076,109 | A | 6/2000 | Kikinis | |
| 6,095,820 | A | 8/2000 | Luxon et al. | |
| 6,100,843 | A | 8/2000 | Proctor, Jr. et al. | |
| 6,295,028 | B1 * | 9/2001 | Jonsson et al. | 343/700 MS |

* cited by examiner

*Primary Examiner*—Don Wong
*Assistant Examiner*—James Clinger
(74) *Attorney, Agent, or Firm*—Sughrue Mion, PLLC

(57) ABSTRACT

This invention relates to a tapered slot antenna with broadband characteristics whose beamwidth is stable over both the PCS (1850–1990 MHz) and the cellular bands (824–894 MHz). In a first preferred embodiment, a dual band antenna is disclosed which uses a single column elliptically shaped Vivaldi notches as the radiating elements. In a second preferred embodiment, a dual band antenna comprising elliptically shaped Vivaldi notches and sub-reflector positioned between a main reflector and the dipoles is disclosed. This resultant antenna produces a stable, ninety-degree beamwidth with a bandwidth broad enough to cover the PCS and the cellular bands.

17 Claims, 17 Drawing Sheets

APLD65

SIDE BY SIDE COLUMNS
FOR PCS & CELLULAR

ADVANTAGES:
1) METAL WALL SEPARATES PCS & CELLULAR ELEMENTS. THIS ELIMINATED ANY INTERFERENCE AND ALLOWED FOR GOOD ELEVATION PATTERNS.
2) 90° SINGLE COLUMN VERSION POSSIBLE.

DISADVANTAGES:
1) NON-CONCENTRIC DESIGN LED TO ASYMMETRICAL PATTERNS THAT SKEWED OFF BORESIGHT
2) DOZENS OF I.M. PRONE MECHANICAL JOINTS.
3) VERY EXPENSIVE
4) 14" WIDE
5) TWO CONNECTORS

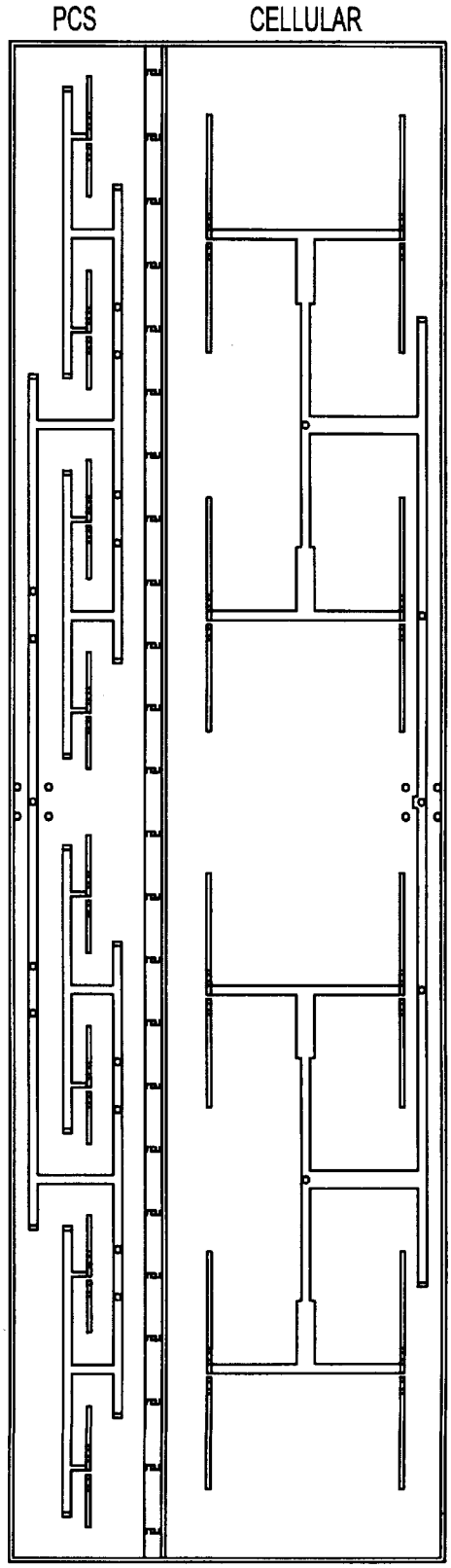

FIG. 1
(PRIOR ART)

APLD90

SIDE BY SIDE COLUMNS
FOR PCS & CELLULAR

ADVANTAGES:
1) METAL WALL SEPARATES PCS & CELLULAR ELEMENTS. THIS ELIMINATED ANY INTERFERENCE AND ALLOWED FOR GOOD ELEVATION PATTERNS.
2) 90° SINGLE COLUMN VERSION POSSIBLE.

DISADVANTAGES:
3) NON-CONCENTRIC DESIGN LED TO ASYMMETRICAL PATTERNS THAT SKEWED OFF BORESIGHT
4) DOZENS OF I.M. PRONE MECHANICAL JOINTS.
5) VERY EXPENSIVE
6) 14" WIDE
7) TWO CONNECTORS

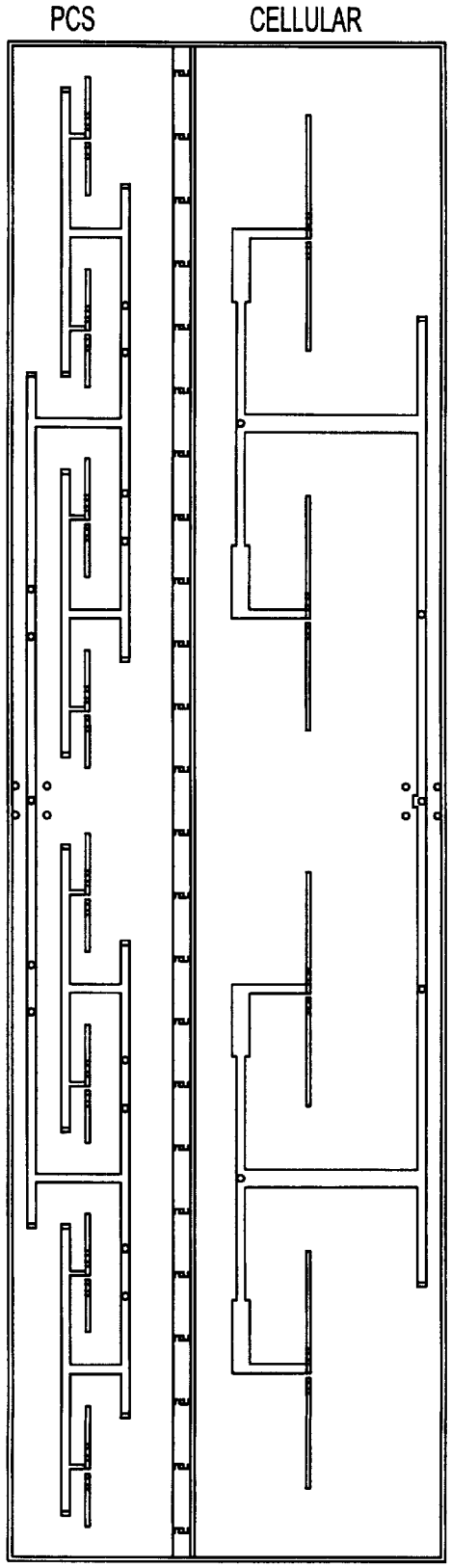

FIG. 2
(PRIOR ART)

APD88/186013/16

CONCENTRIC COLUMNS
FOR PCS & CELLULAR BANDS

ADVANTAGES:
1) SYMMETRICAL AZIMUTH PATTERNS FOR BOTH BANDS.
2) STABLE 60° BEAMWIDTHS FOR BOTH BANDS.

DISADVANTAGES:
1) CELLULAR DIPOLES INTERFERED W/ PCS ELEVATION PATTERNS.
2) DOZENS OF I.M. PRONE MECHANICAL JOINTS.
3) VERY EXPENSIVE
4) 11" WIDE
5) NOT CAPABLE OF GENERATING A 90° PATTERN SINCE BOTH BANDS WOULD ONLY HAVE A SINGLE COLUMN THAT WOULD WANT TO BE IN THE MIDDLE OF THE ANTENNA.

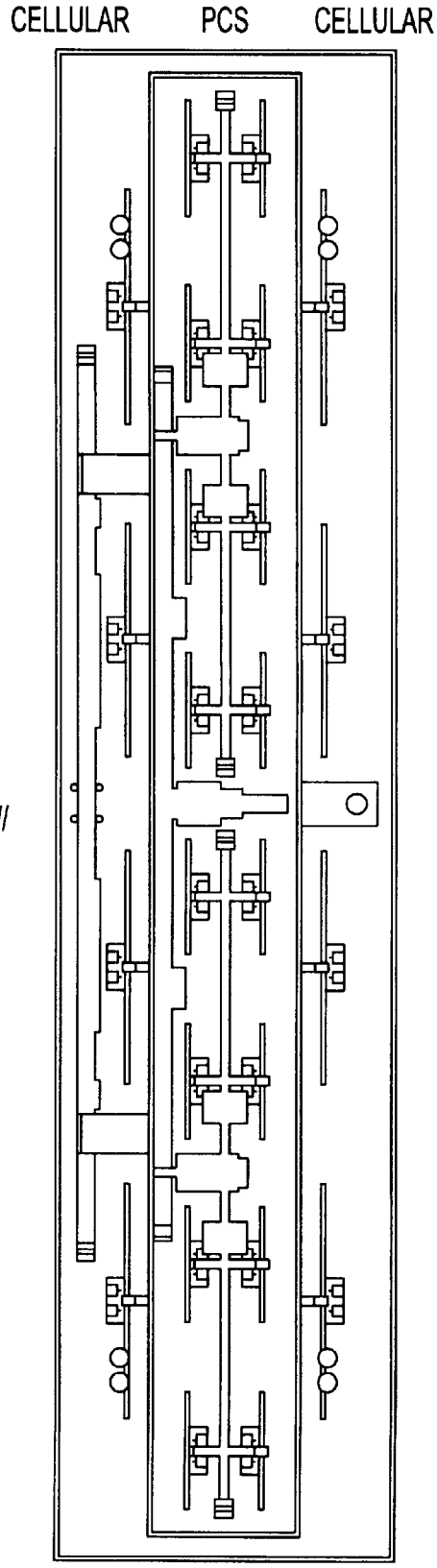

FIG. 5
(PRIOR ART)

ELECTROMAGNETIC SURFACE PATCH CODE VER IV
GEOMETRY PLOT
FILE: C:\ESP\APDV\old\1920_40u.spc
DATE: 9 - 11- 2000
TIME: 8:24

AP199012V

ADVANTAGES:
1) BROAD BANDWIDTH.
2) ONE RADIATING ELEMENT COVERS PCS & CELLULAR.
3) VERY FEW MECHANICAL JOINTS.
4) NARROW, ONLY 4" WIDE.
5) PATTERNS ARE SYMMETRICAL.

DISADVANTAGE
1) CELLULAR PATTERNS BROADEN TOO MUCH
(SEE FIGURE 3A)

LARGE VARIATION IN BEAM WIDTH
PCS = 90°
CELLULAR = 110°
TOO BIG

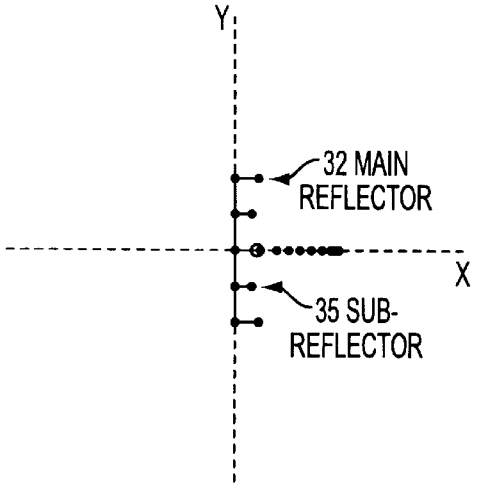
ELECTROMAGNETIC SURFACE PATCH CODE VER IV
GEOMETRY PLOT
FILE: C:\ESP\APDV\new\rev_00\dual14_c.spc
DATE: 9 - 11- 2000
TIME: 9:35
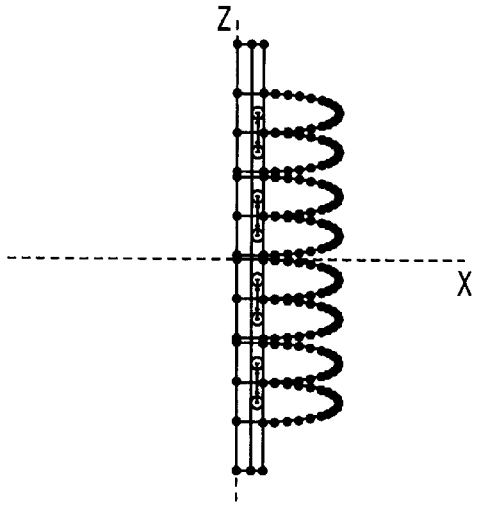
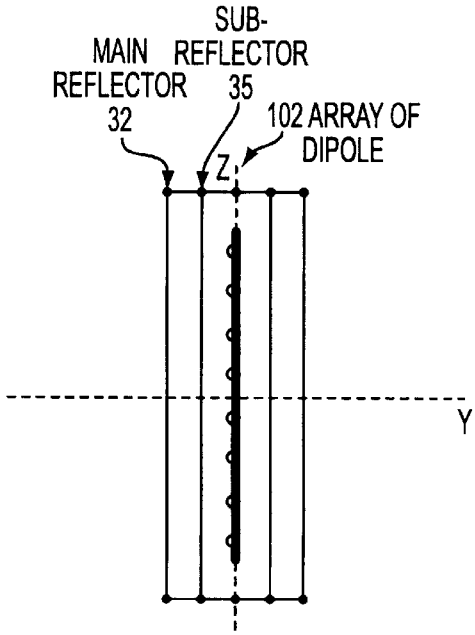
APDV90
ADVANTAGES:
1) SAME BROAD BANDWIDTH AS AP199012 V ALLOWS ONE ELEMENT FOR PCS & CELLULAR.
2) BEAMWIDTH REMAINS CLOSE TO 90°. (SEE FIGURE 4a)
3) BEAMPEAK STAYS CLOSE TO 0° BORESIGHT. (SEE FIGURE 4a)
4) VERY FEW MECHANICAL JOINTS.
DISADVANTAGE
1) REFLECTOR WIDENED TO 8"
FIG. 14

APDV SIMULATED PATTERNS

SIMULATED RESULTS

DUAL BAND ANTENNA USING A SINGLE COLUMN OF ELLIPTICAL VIVALDI NOTCHES

FIELD OF INVENTION

This invention is related to the field of dual-band antennas. More particularly, this invention relates to a tapered slot antenna with broadband characteristics whose beamwidth is stable over both the PCS (1850–1990 MHz) and the cellular bands (824–894 MHz).

BACKGROUND OF INVENTION

In the field of mobile communication, there are two major frequency bands, PCS and cellular. In an effort to reduce size, power consumption and cost, it would be optimal to use one antenna for both frequency bands. Current dual-band antennas use two separate columns of radiating elements (e.g., dipoles), one for PCS and the other for cellular. As a result, power is sent in unequal amounts to the left or the right of the boresight, i.e., it produces an asymmetrical beamwidth pattern. The amount of power differential varies with frequency.

For example, FIGS. 1 and 2 disclose the use of two separate columns of radiating elements (e.g., dipoles), one for PCS and the other for cellular. Note the asymmetry in the beamwidths produced by the cellular and the PCS beamwidths. (See FIGS. 3 and 4). The beamwidth produced over he PCS frequency range is skewed to the left of the boresight when compared to the beamwidth produced by the antenna over the cellular bandwidth. This illustrates how the antenna sends the power in unequal amounts to the left or right of the boresight depending upon the frequency. Another disadvantage over using separate columns of dipoles for the two bandwidths is that two connectors are needed, one for each column of dipoles.

FIG. 5 discloses the use of concentric columns of radiating elements (e.g., dipoles) one for PCS (center column) and the surrounding columns for cellular. Although it produces stable, centered beamwidths for both ranges of frequency (see FIGS. 6 and 7), its beamwidth is too narrow. That is, it is not capable of generating a 90 degree beamwidth pattern since both bands would only have a single column that would want to be centered in the antenna.

To produce a symmetrical pattern, one row of dipoles centered in the middle of the reflector is needed. However, this alone is not enough to produce a symmetrical beamwidth pattern. For example, FIGS. 8*a*, 8*b* and 8*c* illustrates a single column of radiating elements in which the radiating elements are circular dipoles in which the radius of curvature of the electrically conductive members defining the tapered slot of the dipole is fixed. This radiating element is disclosed in U.S. Pat. No. 6,043,785, hereby incorporated by reference. As disclosed in FIG. 9, while the antenna will match to 50 ohms across both bands, the beamwidth created using a single column of circular dipoles is not stable over the PCS and cellular bandwidths. That is, there is a large variation in beamwidth when the antenna is used in both the PCs and in the cellular bandwidths. For example, the cellular beamwidth pattern is broadened 20 degrees when compared to the PCS bandwidth.

In summary, current 90 degree antennas capable of covering both the PCS and the cellular bandwidths are either not stable or send power in unequal amounts to the left or the right of the boresight, i.e., it produces an asymmetrical beamwidth pattern.

SUMMARY OF THE INVENTION

The present invention is a broad band antenna for use in both the PCS and the cellular bandwidths. It comprises an array of tapered slots which are mounted on a reflector. Furthermore, a feedline is operably connected to said array of tapered slots for routing RF and microwave signals. Each of the tapered slots consists of a pair of elliptically shaped members, having a gap between said pair of elliptically shaped members. The slot is exited by a section of feedline that runs perpendicular to the gap. A plurality of tapered slots may be arrayed, with a space between each of said tapered slots. Said space serving to create a desired inter-element spacing.

In another preferred embodiment, each of said plurality of elliptically shaped members is a dipole wherein the height and width of the elliptically shaped members comprises a ratio of 2:1.

In still another preferred embodiment, the reflector further comprises at least one main reflector operably connected to the ends of said reflector which run parallel to array of tapered slots and at least one sub-reflector operably connected between the main reflectors and the array of tapered slots.

In still another preferred embodiment, the antenna is an element of a telecommunications system.

BRIEF DESCRIPTION OF THE DRAWINGS

FIG. 1 is a drawing of a broadband antenna with side by side columns for PCS and Cellular.

FIG. 2 is a drawing of a broadband antenna with side by side columns for PCS and Cellular.

FIG. 5 discloses the use of concentric columns of radiating elements.

FIG. 14 illustrates the use of a sub-reflector.

DETAILED DESCRIPTION OF THE INVENTION

In a first preferred embodiment, a dual band antenna is disclosed which uses elliptically shaped Vivaldi notches as the radiating elements. In a second preferred embodiment, a dual band antenna comprising elliptically shaped Vivaldi notches and sub-reflector positioned between a main reflector and the dipoles is disclosed. This resultant antenna produces a ninety degree beamwidth with a stable bandwidth broad enough to cover the PCS and the cellular bands. The elements of the antenna comprise elliptical Vivaldi notches (i.e., an array of elliptically tapered slots), a reflector with a main reflector and a sub-reflector.

Elliptically Shaped Slots

The first feature of the present invention that improves antenna performance is the use of elliptically shaped slots. Each elliptically tapered slot is defined by a gap between two elliptically shaped members 12, 13 formed on a metalized layer on one side of a dielectric substrate 10. The elliptically shaped members are defined by the formula $x^2/a^2+y^2/b^2=1$, where a is the height and b is the width of the elliptically shaped members.

Figure 3:
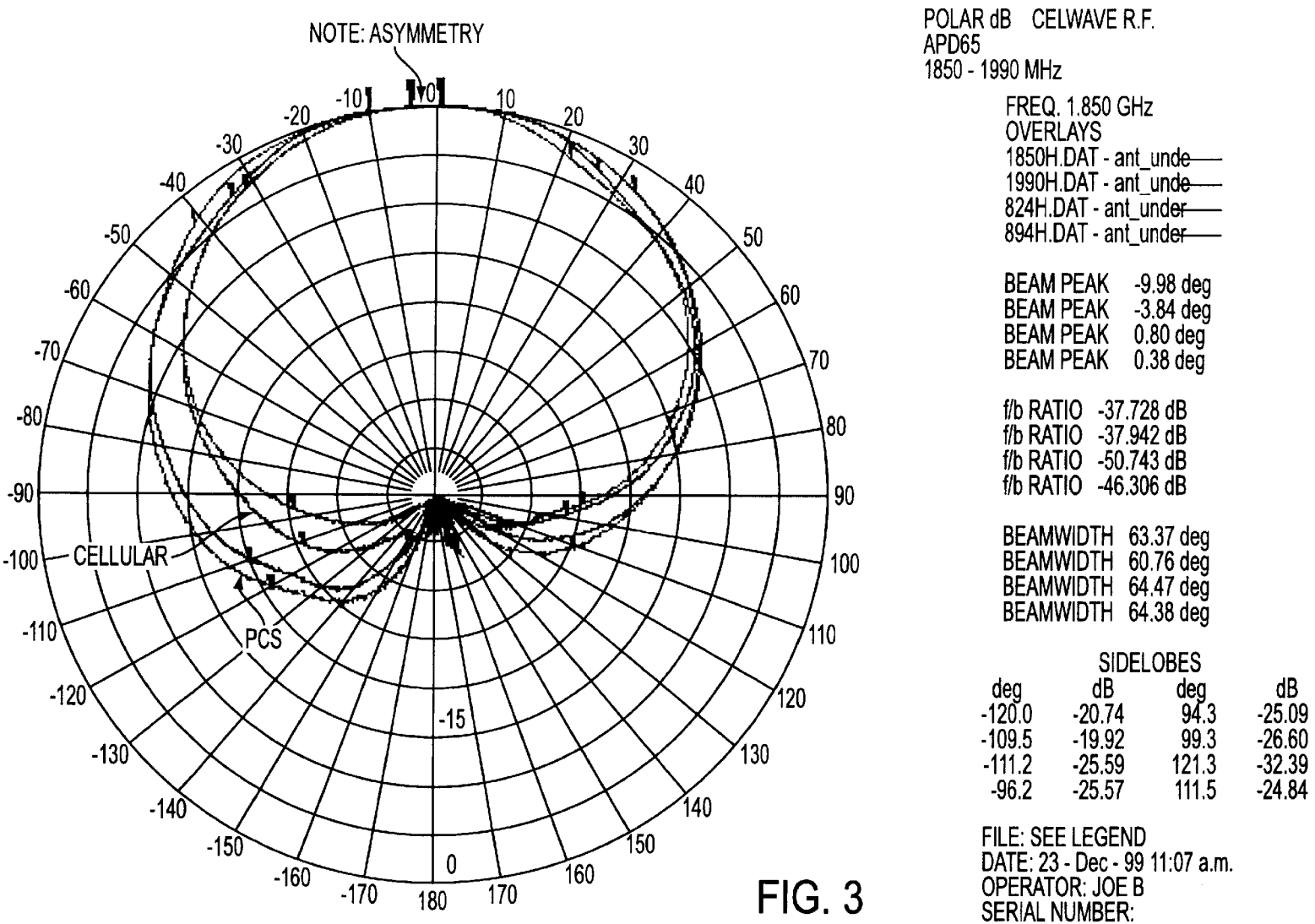
FIGS. 3 and 4 are plots of the beamwidth patterns for the broadband antennas illustrated in FIGS. 1 and 2 respectively.
Figure 4:
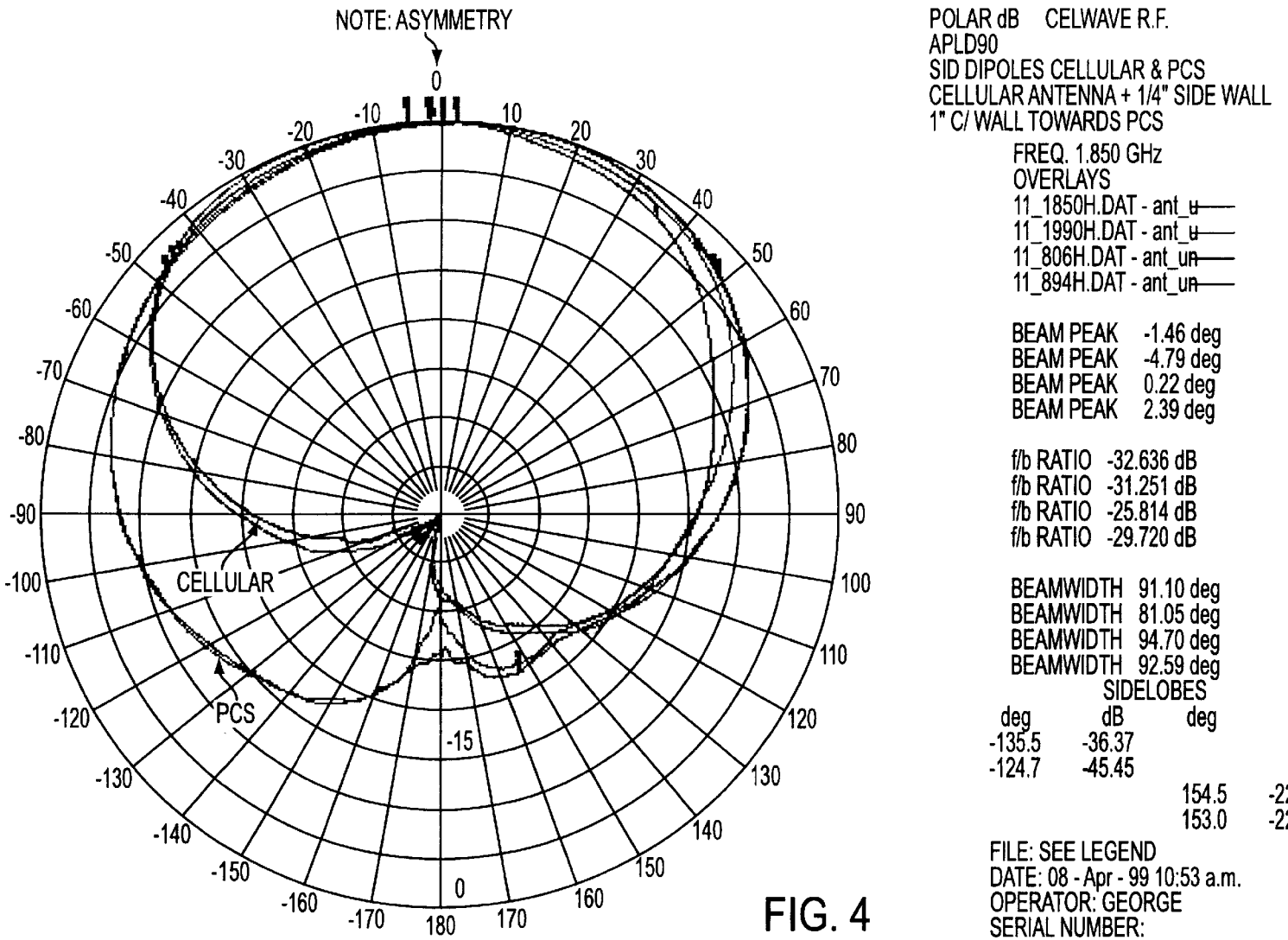
Figure 6:
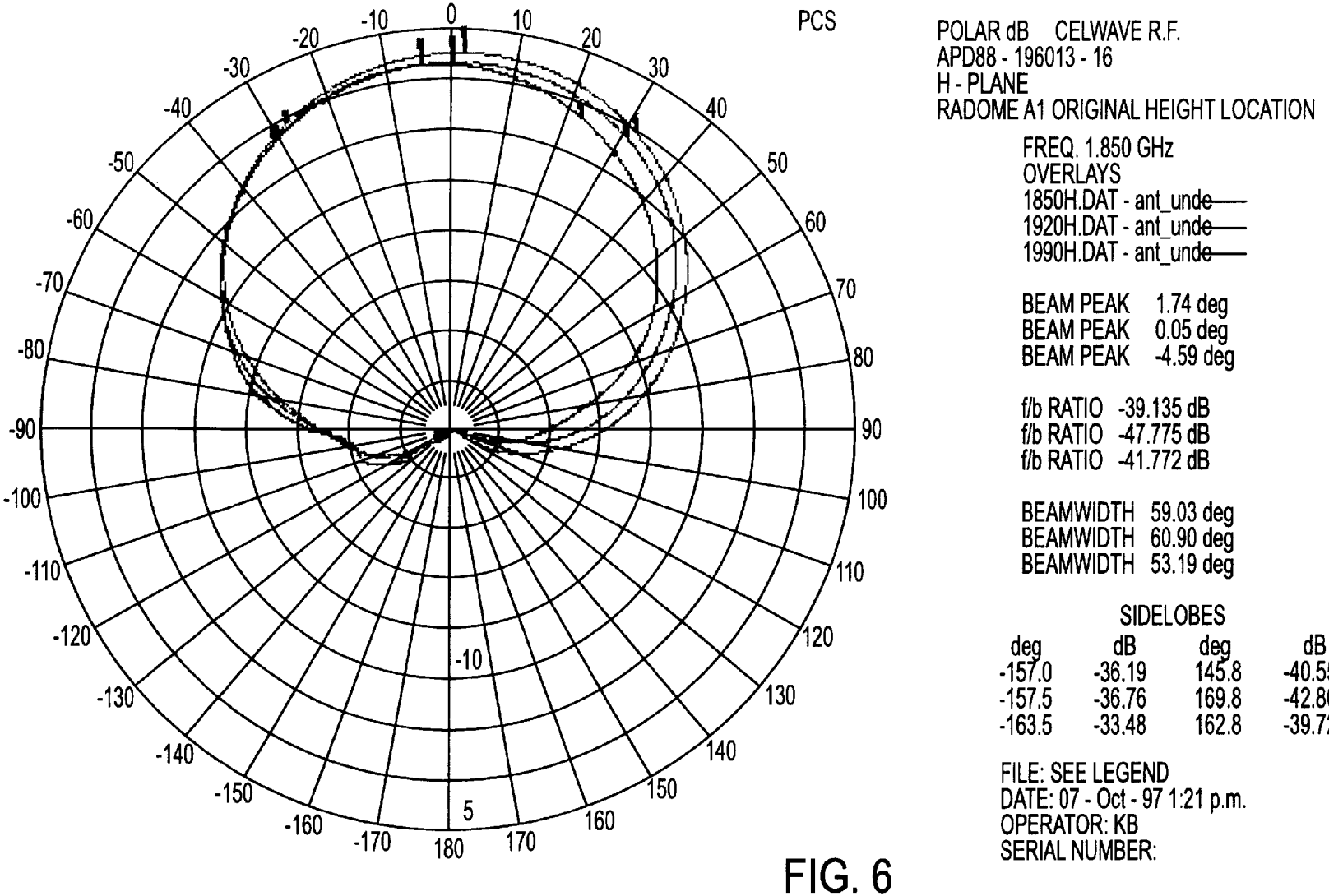
FIGS. 6 and 7 are plots of the beamwidth patterns for the broadband antenna illustrated in FIG. 5 for the PCS and cellular bandwidths respectively.
Figure 7:
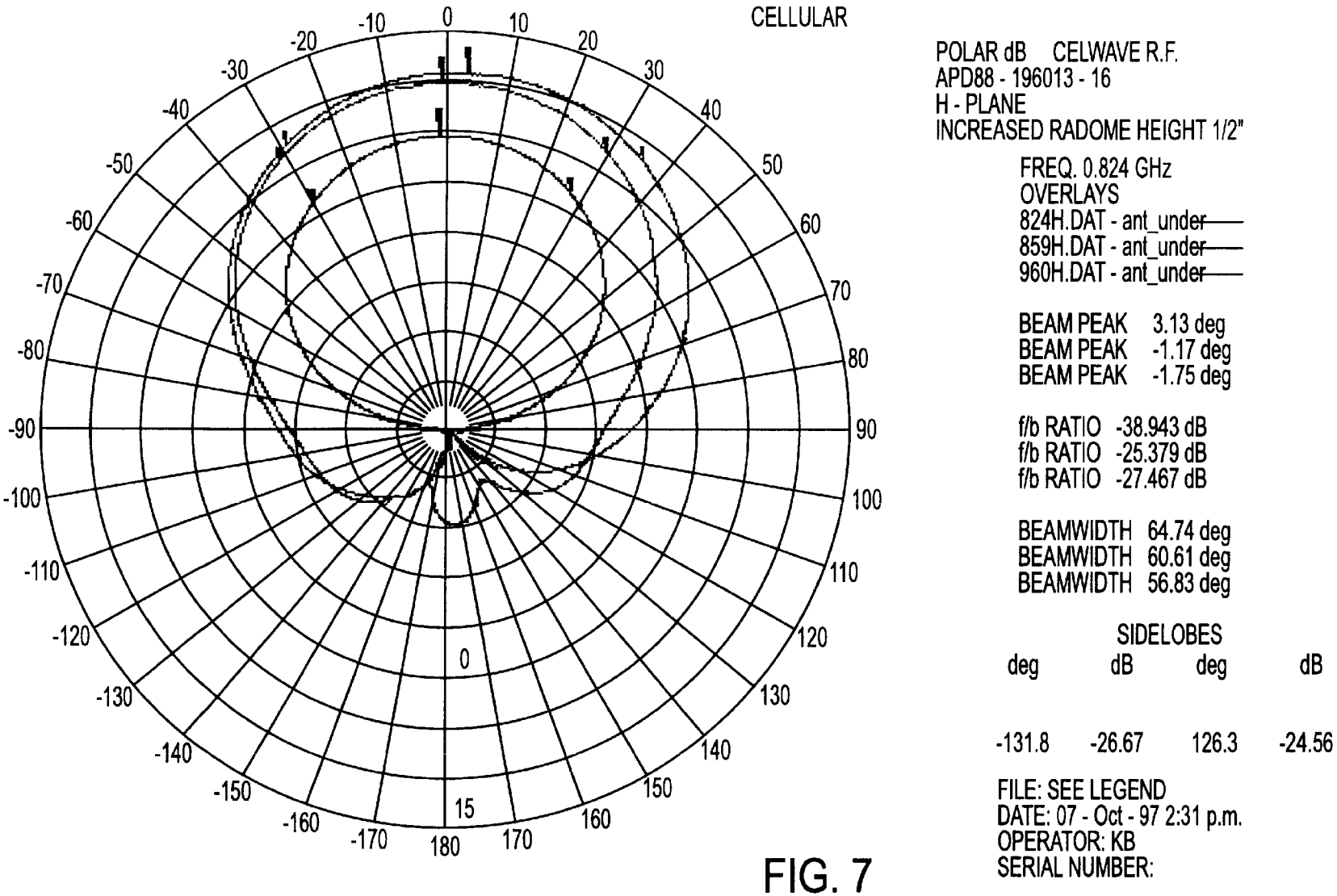
Figure 8A:
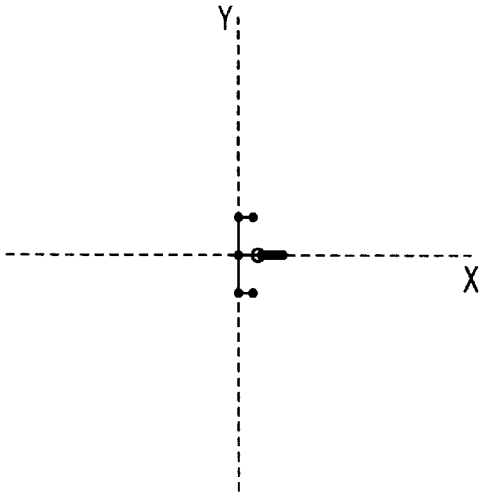
FIG. 8A (PRIOR ART)
FIGS. 8*a*, 8*b* and 8*c* illustrates a single column of radiating elements in which the radiating elements are circular dipoles.
Figure 8B:
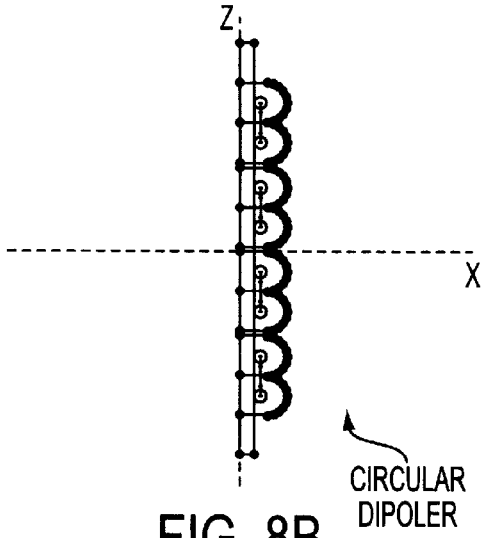
FIG. 8B (PRIOR ART)
Figure 8C:
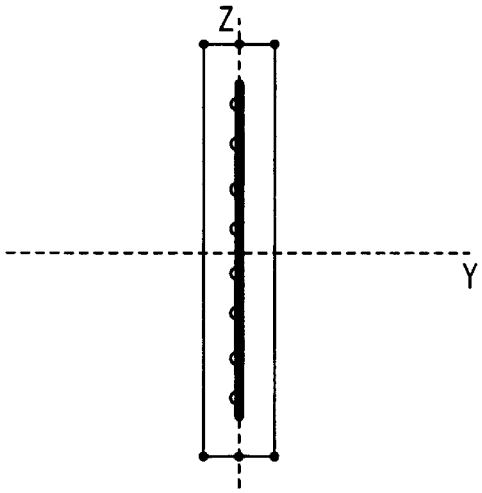
FIG. 8C (PRIOR ART)
Figure 9:
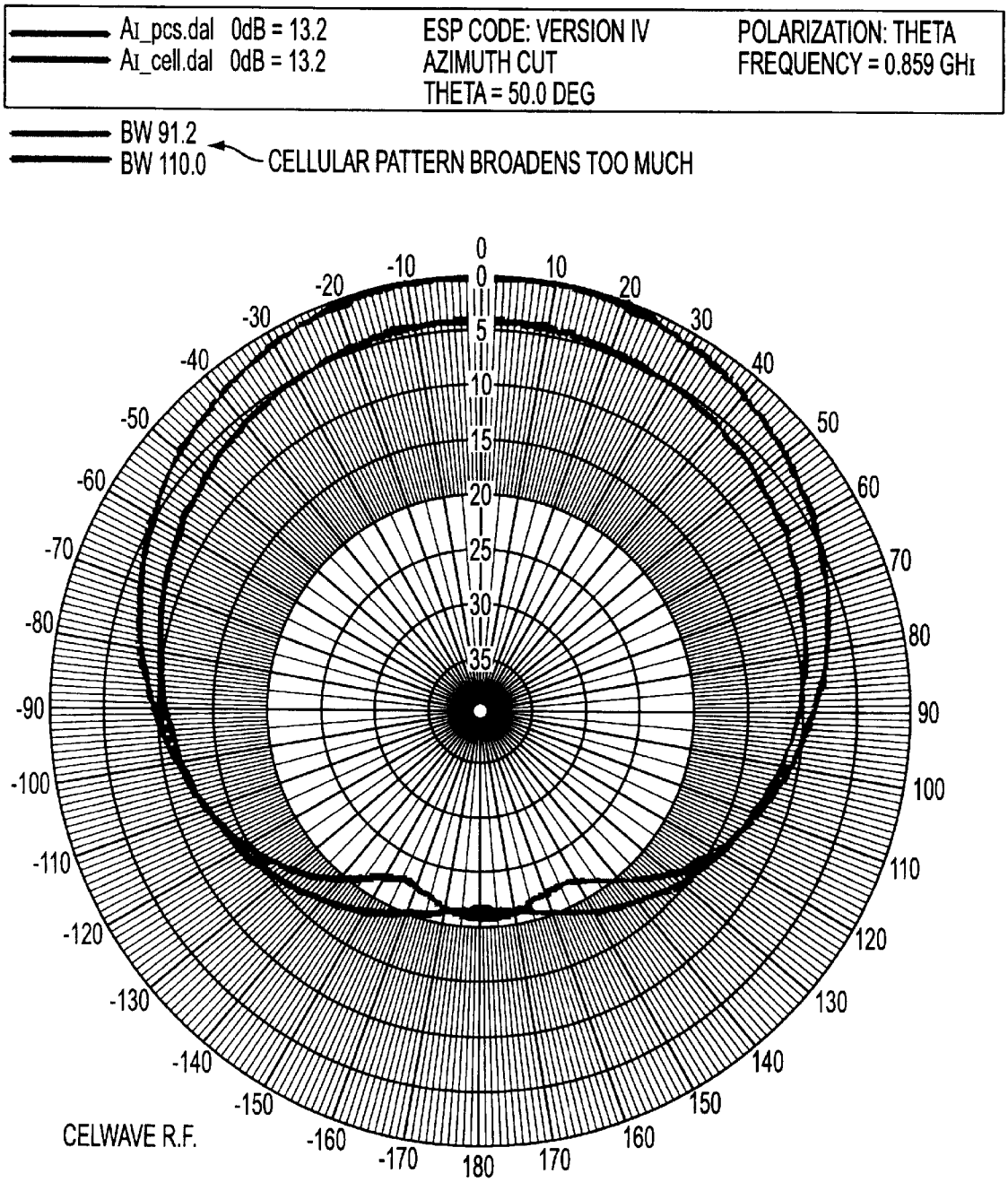
FIG. 9 is a plot of the beamwidth patterns for the cellular and the PCS bandwidths for the antenna illustrated in FIG. 8.
Figure 10:
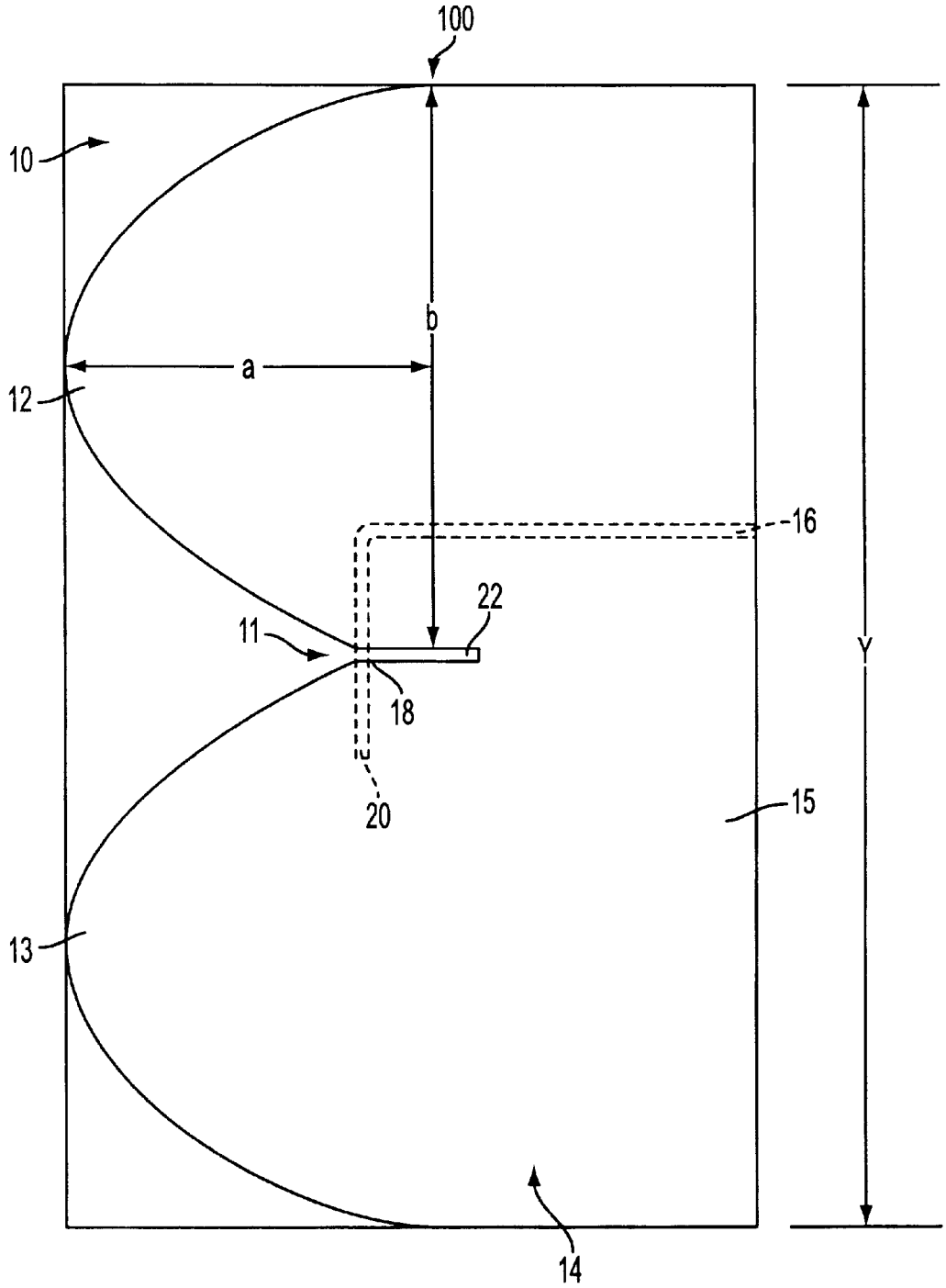
FIG. 10 is a drawing of an elliptically shaped Vivaldi antenna of the present invention.

FIG. 10 is a drawing of an elliptically shaped Vivaldi antenna 100 produced on a printed circuit board. The slot antenna is defined by a spacing 11 between the two elliptically shaped members 12, 13 formed on the metalized layer 14 on one side of a printed circuit board. (Circuit boards fabricated from glass-epoxy or polyamide can be used. In addition, microstrip, stripline or other dielectric substrates 10 capable of carrying RF and microwave signals can be used). The invention differs from the Vivaldi antenna disclosed in U.S. Pat. No. 6,053,785 in that the radius, R, of the electrically conductive members 12 and 13 is not fixed, but varies elliptically. On the other side of the printed circuit board, a conventional feedline 16 can be used to supply power.

Figure 11B:
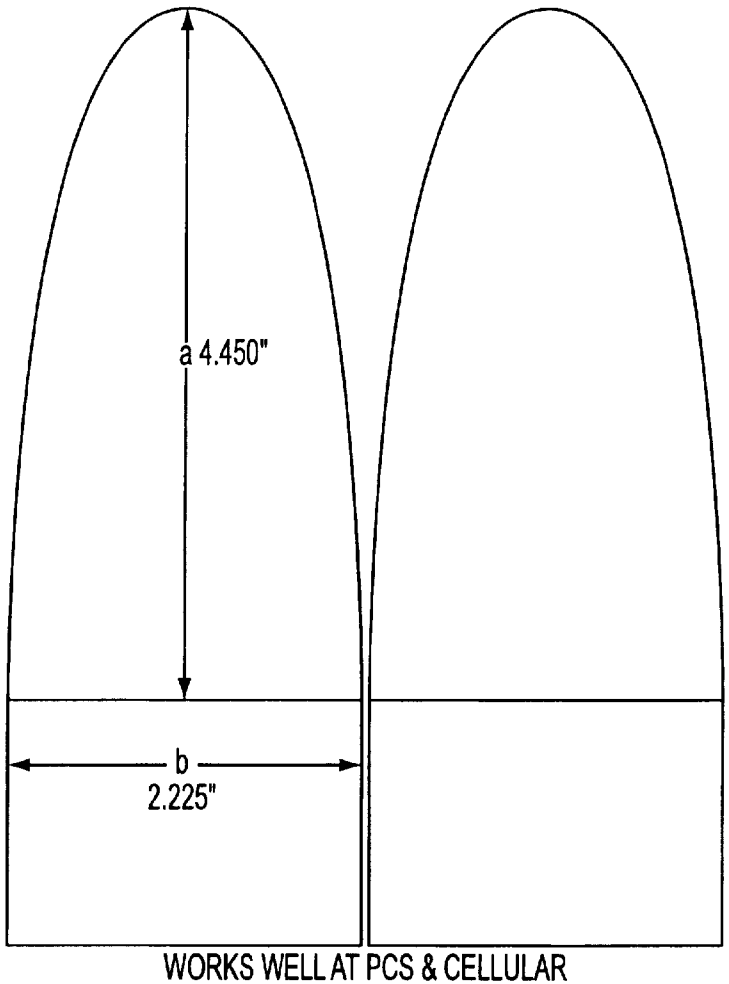
FIG. 11*b* discloses an embodiment of the elliptically shaped Vivaldi antenna in which a 2:1 ratio between height and width of the elliptically shaped dipole is used.
Figure 11A:
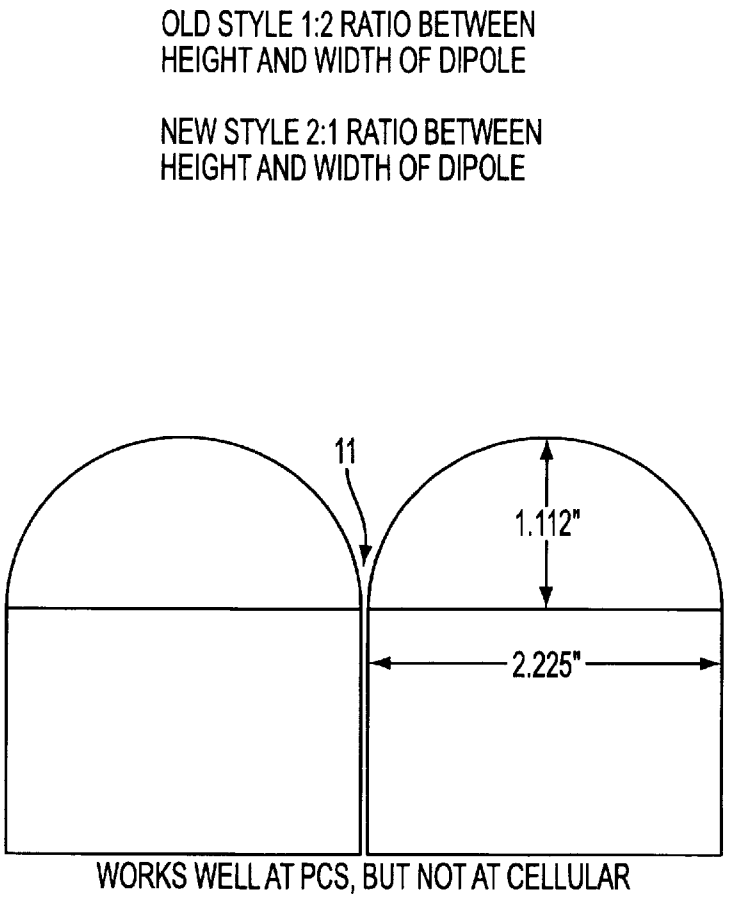
FIG. 11*a* discloses an elliptically shaped dipole.

FIG. 11*a* discloses an elliptically shaped dipole. FIG. 11*b* discloses an embodiment in which a 2:1 ratio between height and width of the elliptically shaped dipole is used. The lowest operating frequency of the antenna is a function of the height of the dipole, which in FIG. 11*b* would be a+b. In a preferred embodiment, the height, a, of the elliptically shaped elements is about 4.450" while the width, b, is 2.225."

To keep undesired grating lobes to a minimum, it is preferable to keep the element spacing S smaller than the shortest operating wavelength. In a preferred embodiment, the element spacing S equals 0.8 times the wavelength at 1990 MHz (PCS bandwidth).

Figure 12:
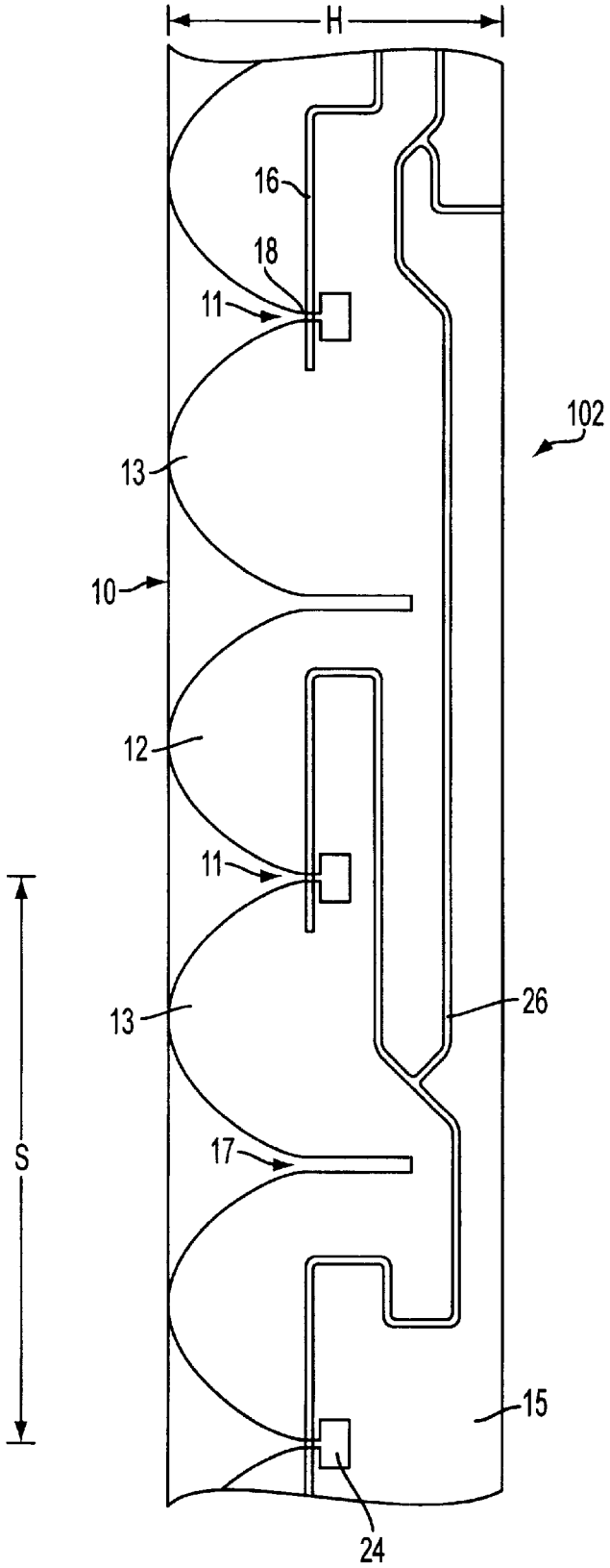
FIG. 12 illustrates an array of elliptically shaped tapered slot antennas.

There is a space 17 that separates each of the antenna elements (or tapered slots or dipoles) in the antenna array (see FIG. 12).

Figure 13:
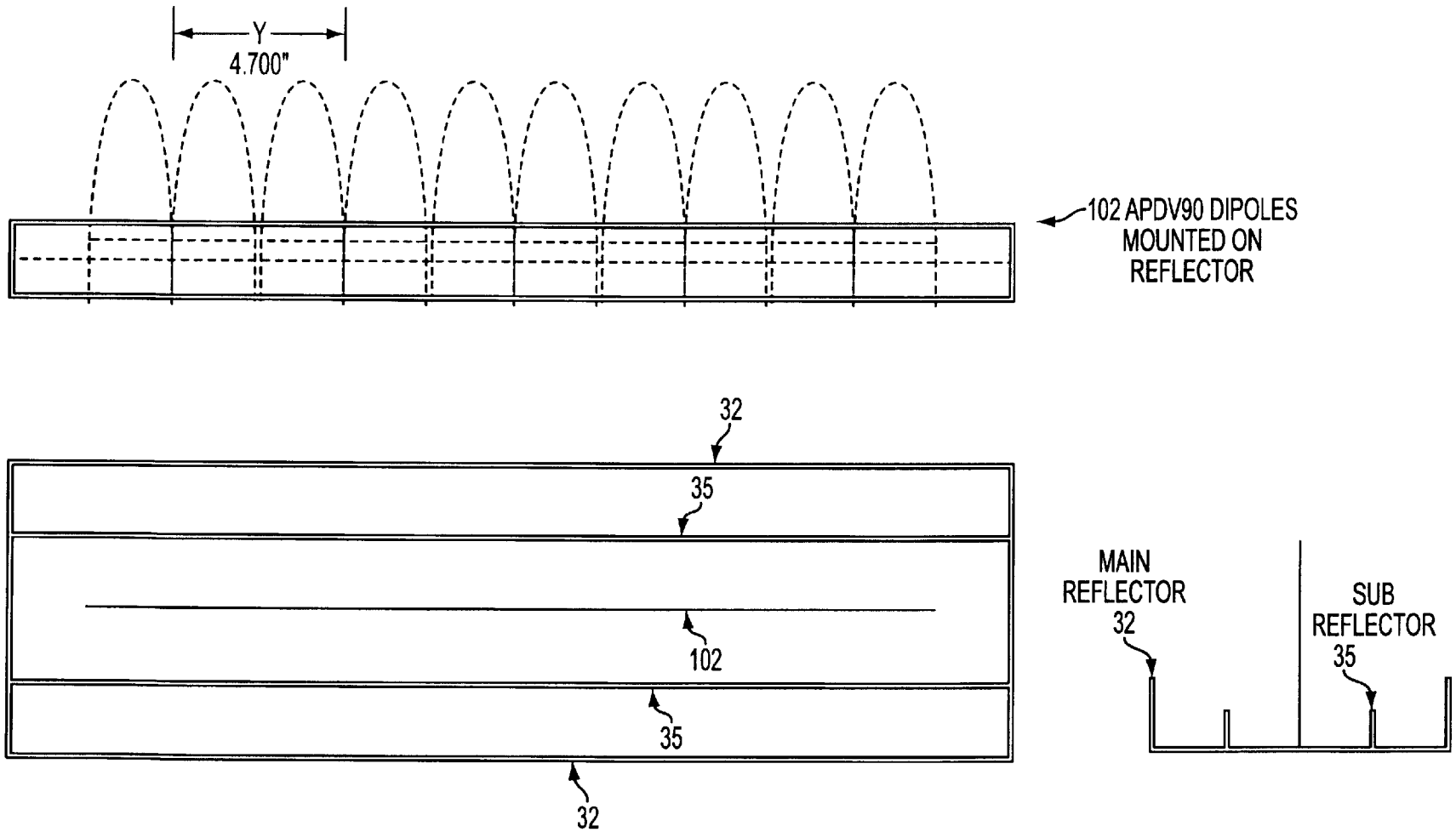
FIG. 13 illustrates the spacing between slot antenna elements mounted on a reflector.

FIG. 13 illustrates the spacing between slot antenna elements Y mounted on a reflector. The element spacing limits the highest operating frequency. In a preferred embodiment, the dipoles are spaced Y not greater than a wavelength apart. Since PCS covers the highest frequency range (1850–1990 MHz), its wavelength is the shortest. Therefore, it determines the maximum spacing between dipoles. In a preferred embodiment, the spacing between slots is 4.7".

Reflector and Sub-Reflector

A second improvement displayed by the present invention is the use of a second reflector, or sub-reflector. Most antennas comprise an array of dipoles 102 that sit on a single reflector 30 (see U.S. Pat. No. 6,043,785). The single reflector comprises a lip or edge or main reflector 32 formed on each side of the reflector 30. While the reflector 30 is substantially perpendicular to the metalized layer of the antenna array, the lip or edge 32 on both sides of the array is substantially parallel to the array.

A single reflector 30 is used to improve radiation performance. However, it produces large variations in the beamwidth when operating in two different frequency bands. Adding a second lip or edge, or sub-reflector 35, halfway between the lips 32 and the dipoles serves to widen the PCS beam, while narrowing the cellular beam, resulting in a stable beamwidth over frequency. In a preferred embodiment, both the reflector lips 32 and the sub-reflectors 35 are substantially parallel to the metalized layer of the antenna array 102 (See FIG. 13).

Figure 15:
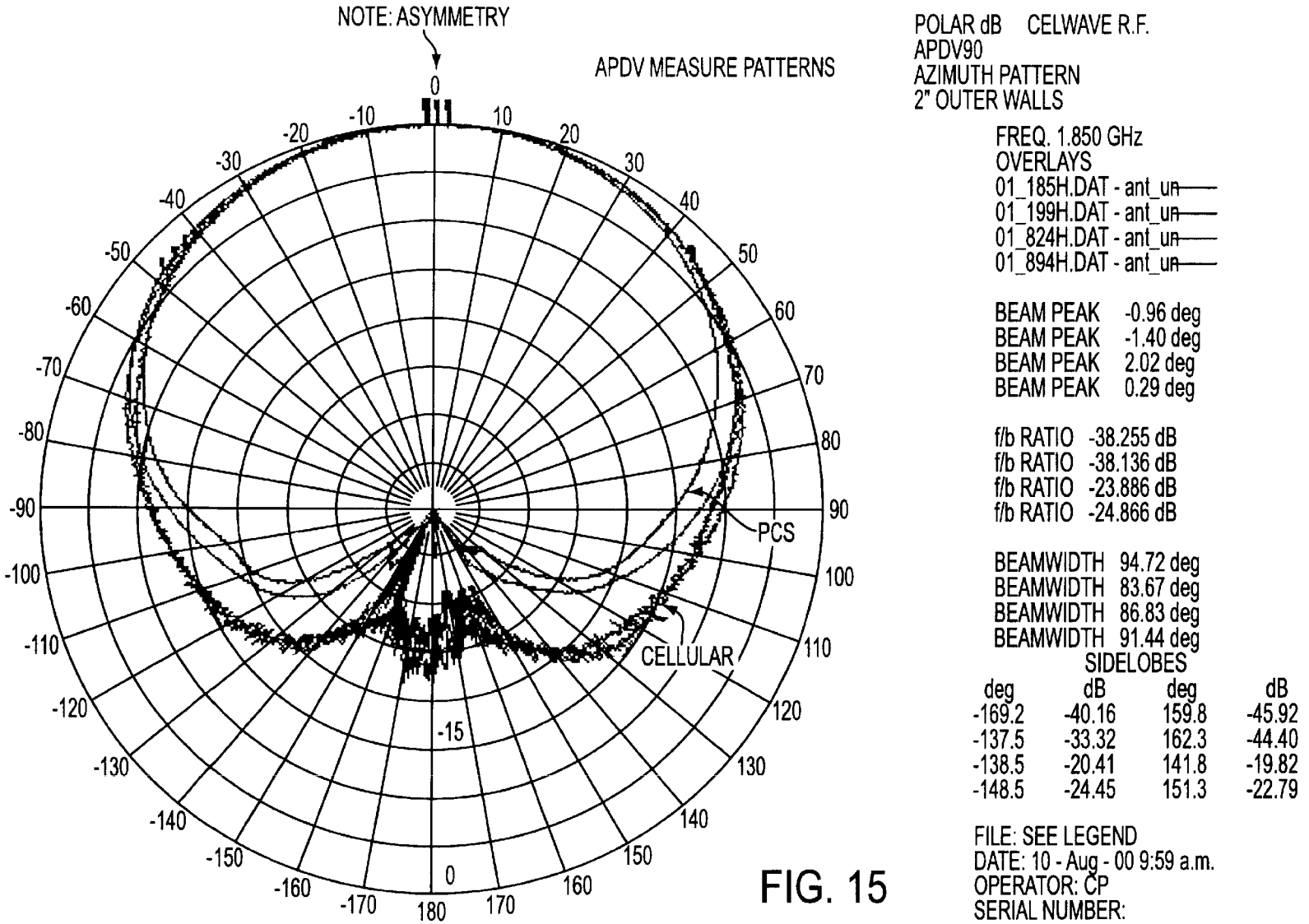
FIG. 15 is a plot of the beamwidth patterns for the cellular and the PCS bandwidths for the present invention.
Figure 16:
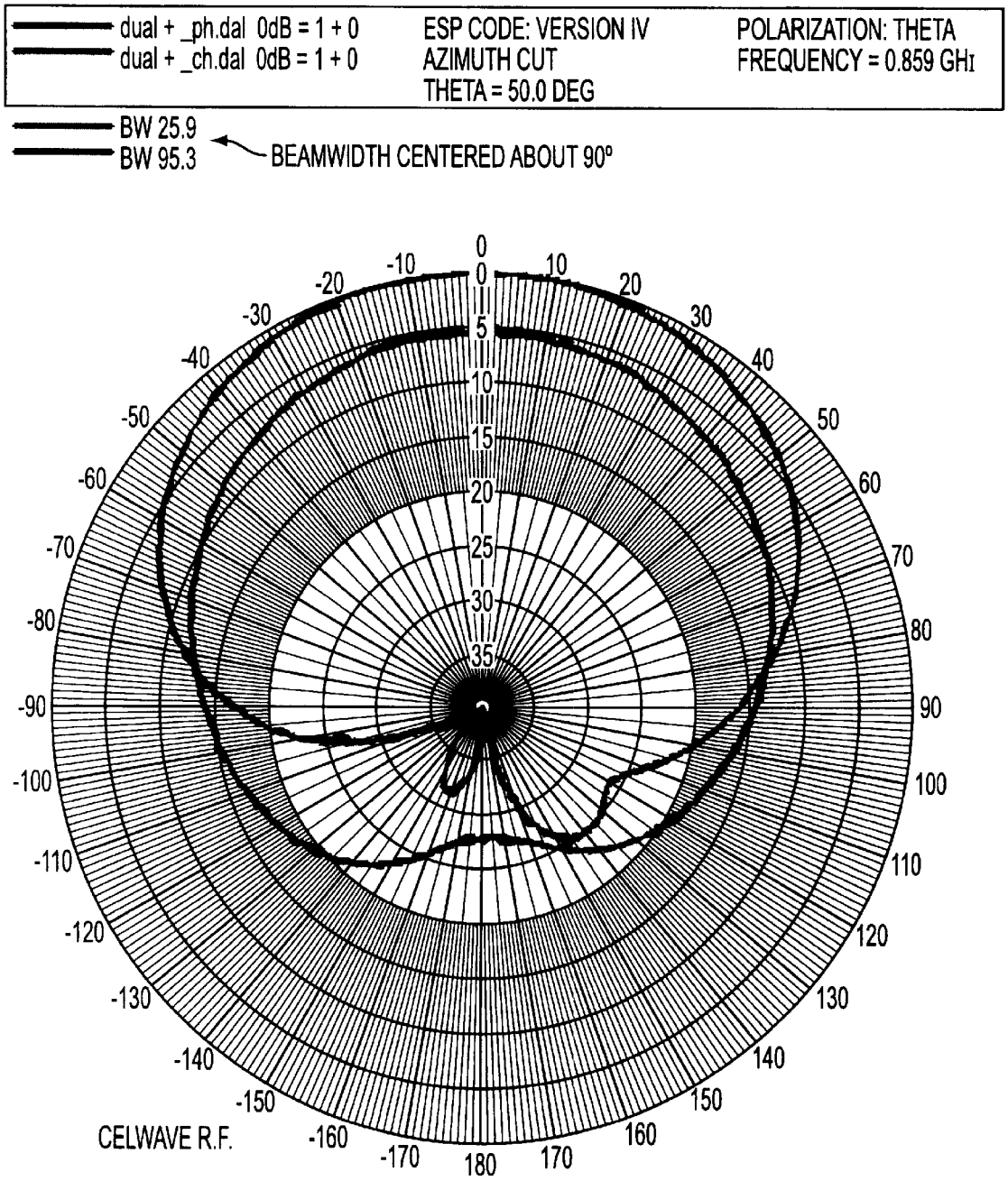
FIG. 16 is a plot of simulated results for the beamwidth patterns for the cellular and the PCS bandwidths for the present invention.

FIG. 14 illustrates the use of a sub-reflector 35. In a preferred embodiment, it is placed midway between the reflector lips 32 and the centered column of dipoles 102 on both sides of the dipoles 102. As FIGS. 15 (measured beamwidth patterns) and 16 (simulated beamwidth patterns) illustrate, a 30 degree difference in measured beamwidths between the PCS and the cellular bandwidths when not using a sub-reflector is reduced to a 10 degree difference (84 to 95 degrees) when a sub-reflector is used, thereby enhancing beam stability over frequency. In addition, the boresight is centered at zero degrees and not lopsided as with the antennas disclosed in the prior art.

Figure 17:
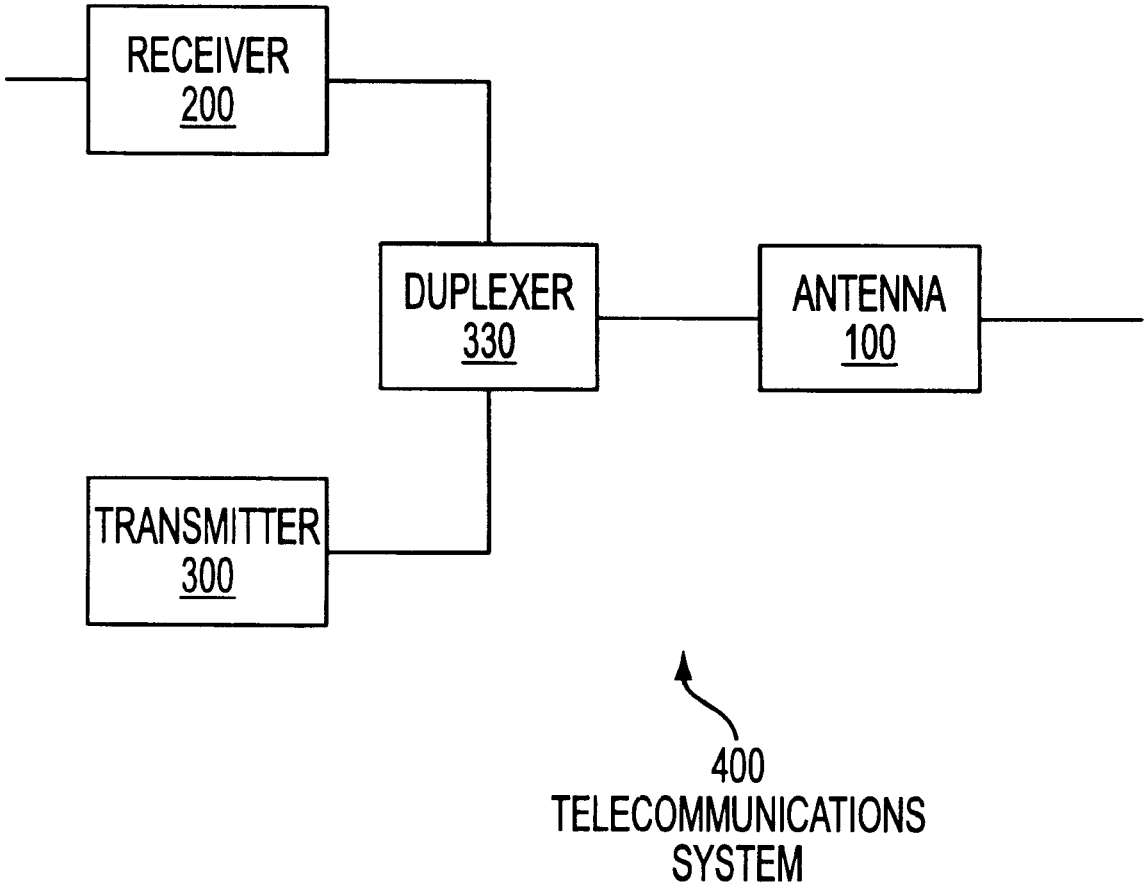
FIG. 17 is a block diagram of a telecommunication system utilizing the present invention.

It should be noted that this dual band (or broadband antenna) can be used in a telecommunication system 400. For example, it can be used in the telecommunications system disclosed in U.S. Pat. No. 5,812,933, hereby incorporated by reference. In a preferred embodiment, the telecommunication system 400 comprises a receiver 200, a transmitter 300, a duplexer 350 operably connected to said receiver 200 and said transmitter 300 and the broadband antenna 100 operably connected to the duplexer 350 (see FIG. 17).

While the invention has been disclosed in this patent application by reference to the details of preferred embodiments of the invention, it is to be understood that the disclosure is intended in an illustrative rather than in a limiting sense, as it is contemplated that modification will readily occur to those skilled in the art, within the spirit of the invention and the scope of the appended claims and their equivalents.

What is claimed is:

1. A dual band antenna comprising:

an array of tapered slots comprising:

a pair of elliptically shaped members having a gap between said pair of elliptically shaped members; and a space between each of said tapered slots;

a reflector upon which said array of tapered slots is mounted; and a feedline operably connected to said array of tapered slots for routing RF and microwave signals.

2. The dual band antenna according to claim 1, wherein said reflector further comprises:

at least one main reflector operably connected to at least one end of said reflector; and at least one sub-reflector operably connected between said at least one main reflector and said array of tapered slots.

3. The dual band antenna according to claim 1, wherein said space creates an inter-element spacing that is less than or equal to the longest operating wavelength.

4. The dual band antenna according to claim 1, wherein each of said pair of elliptically shaped members is a dipole.

5. The dual band antenna according to claim 1, wherein a height and a width of said elliptically shaped members comprises a ratio of 2:1.

6. The dual band antenna according to claim 1, wherein said array of tapered slots is formed on dielectric substrate.

7. The dual band antenna according to claim 2, wherein said at least one sub-reflector is operably connected halfway between said at least one main reflector and said array of tapered slots.

8.The dual band antenna according to claim 4, wherein said dipoles are spaced less than a wavelength apart.

9. The dual band antenna according to claim 7, wherein said reflector is substantially perpendicular to said array of tapered slots, and said at least one main reflector and said at least one sub-reflector are substantially parallel to said array of tapered slots.

10. The dual band antenna according to claim 8, wherein a height and a width of said elliptically shaped members comprises a ratio of 2:1; and wherein said array of tapered slotsis formed on dielectric substrate.

11. A method of producing a symmetrical and stable beamwidth over a broad bandwidth, comprising the steps of:

centering an array of tapered slots in the middle of a reflector; and reflecting radiated energy from at least one edge of said reflector, wherein said at least one edge is parallel to said array of tapered slots; and radiating and receiving energy from at least one dipole located on said array of tapered slots;

wherein said array of tapered slots comprises a space between each of said tapered slots; and said dipole is comprised of elliptically shaped members having a gap between said elliptically shaped members.

12. The method according to claim 11, further comprising the step of reflecting said radiated energy from at least one sub-reflector located between said at least one parallel edge and said array of tapered slots.

13. The method according to claim 11 wherein each of said dipole is formed on a dielectric substrate; wherein a height and a width of said elliptically shaped members comprises a ratio of 2:1; and wherein said dipoles are spaced not greater than a wavelength apart.

14. The method of claim 11, wherein a ratio of a height of said elliptically shaped members to a width of said elliptically shaped members is greater than 1:2.

15. A broadband telecommunications system, comprising:

a receiver;

a transmitter;

a duplexer operably connected to said receiver and said transmitter; and a broadband antenna operably connected to said duplexer, comprising:

an array of tapered slots;

a reflector upon which said aray of tapered slots is mounted;

a feedline operably connected to said aray of tapered slots for routing RF and microwave signals;

a space between each of said tapered slots; and wherein each of said tapered slots comprises a pair of elliptically shaped members having a gap between said pair of elliptically shaped members.

16. The broadband antenna according to claim 15, wherein said reflector further comprises:

at least one main reflector operably connected to at least one end of said reflector; and at least one sub-reflector operably connected between said at least one main reflector and said array of tapered slots.

17. The broadband antenna of claim 16, wherein said at least one sub-reflector is operably connected halfway between said at least one main reflector and said array of tapered slots.

* * * * *